US008074717B2

(12) United States Patent
Tutuncu

(10) Patent No.: US 8,074,717 B2
(45) Date of Patent: Dec. 13, 2011

(54) DRILLING METHOD AND DOWNHOLE CLEANING TOOL

(75) Inventor: Azra Nur Tutuncu, Houston, TX (US)

(73) Assignee: Shell Oil Company, Houston, TX (US)

( * ) Notice: Subject to any disclaimer, the term of this patent is extended or adjusted under 35 U.S.C. 154(b) by 270 days.

(21) Appl. No.: 12/376,029

(22) PCT Filed: Aug. 1, 2007

(86) PCT No.: PCT/US2007/074948

§ 371 (c)(1),
(2), (4) Date: May 1, 2009

(87) PCT Pub. No.: WO2008/016961

PCT Pub. Date: Feb. 7, 2008

(65) Prior Publication Data

US 2010/0025042 A1 Feb. 4, 2010

Related U.S. Application Data

(60) Provisional application No. 60/821,362, filed on Aug. 3, 2006.

(51) Int. Cl.
*E21B 21/00* (2006.01)
*E21B 37/00* (2006.01)

(52) U.S. Cl. ..... 166/312; 166/223; 175/102

(58) Field of Classification Search ..... 175/92, 175/102, 107, 423; 166/311, 312, 173, 222, 166/223; 15/104.05, 104.09, 104.061; 405/184.1
See application file for complete search history.

(56) References Cited

U.S. PATENT DOCUMENTS

| | | | | | |
|---|---|---|---|---|---|
| 1,695,749 | A * | 12/1928 | Watson | 166/104 |
| 2,937,008 | A * | 5/1960 | Whittle | 415/65 |
| 3,167,126 | A * | 1/1965 | Reineke, Jr. et al. | 166/104 |
| 3,352,370 | A * | 11/1967 | Livingston | 175/73 |
| 3,656,565 | A | 4/1972 | Fox | 175/323 |
| 3,844,362 | A * | 10/1974 | Elbert et al. | 175/94 |
| 4,515,229 | A * | 5/1985 | Drummond et al. | 175/337 |
| 4,909,325 | A | 3/1990 | Hopmann | 166/312 |
| 4,919,204 | A | 4/1990 | Baker | 166/223 |
| 5,158,140 | A | 10/1992 | Ferry | 166/312 |
| 6,189,618 | B1 * | 2/2001 | Beeman et al. | 166/312 |
| 2004/0011522 | A1 * | 1/2004 | Ivannikov et al. | 166/177.6 |
| 2004/0089450 | A1 * | 5/2004 | Slade et al. | 166/298 |

FOREIGN PATENT DOCUMENTS

GB 2341405 3/2000

OTHER PUBLICATIONS

Bakker et al., "Cavitator for Effective Well Cleaning", Apr. 9-10, 2002, pp. 1-4, Houston Texas. Ivannikov/Whirlwind International BV, SPE 75352.

Crabtree, M. et al : "Fighting Scale-Removal and Prevention" Oilfield Review, [Online] 1999, pp. 30-45, XP002455131 Elsevier, Amsterdam NL Retrieved from the Internet: URL:http://www.slb.com/media/services/resources/oilfieldreview/ors99/aut99/fighting.pdf> [retrieved on Oct. 16, 2007] p. 37, col. 2-p. 39, col. 2.

* cited by examiner

*Primary Examiner* — Kenneth L Thompson

(57) ABSTRACT

A method for drilling a well with a drilling apparatus comprising a drill string and a bit, comprising attaching a cleaning tool comprising a coaxial pipe and at least one vortex spinner to a portion of the drill string above the bit, inserting the drill string into a wellbore, extending the wellbore while simultaneously pumping fluid through the cleaning tool to create a fluid flow, and loosening debris attached to the wellbore.

7 Claims, 7 Drawing Sheets

DRILLING METHOD AND DOWNHOLE CLEANING TOOL

PRIORITY CLAIM

The present application claims priority of U.S. Provisional Patent Application No. 60/821,362 filed 3 Aug. 2006.

FIELD OF INVENTION

The present inventions relate to a drilling method a downhole cleaning tool and a method for drilling a well.

BACKGROUND

In the process of drilling an oil and gas well, drilling fluids are commonly used to perform a number of functions. In addition to cooling the bit, providing lubrication, stabilizing fluid loss, and counterbalancing pressure, drilling fluids are circulated to remove pieces of rock chips, gravel, and debris (known as "cuttings") from the wellbore while it is being drilled. Drilling fluid is pumped down the drill string, cuttings are suspended in the fluid and carried out of the well through the annulus between the drill string and the wellbore.

Proper hole cleaning is a requirement in all wells, but it becomes particularly important in drilling highly deviated wells, horizontal wells, and extended reach wells. In drilling such wells, gravity causes cuttings and other debris to build up along the bottom side of the wellbore and form deposits known as "cuttings beds." Drilling fluids are generally ineffective for removing these cuttings, which may cause formation hole fill ups, decreased bit life, differential sticking, decreased rate of penetration and other problems.

Mechanical and chemical solutions have been proposed to address the need for cuttings removal in wells that pose hole-cleaning challenges. Chemical solutions include varying the drilling fluid properties and rates or adding special additives, which enhance the ability of the fluid to transport the cuttings. Usually drilling operations must be stopped while the fluid is added or circulated through the well.

One simple mechanical solution is to rotate the drill pipe to agitate the fluid and mobilize the cuttings. This method is rather ineffective for cleaning large amounts of accumulated cuttings and has limitations when applied in non-rotating drilling operations (e.g. coiled tubing). Another mechanical solution involves attaching an oscillator or vibrator to the end of the drilling apparatus and activating the oscillator or vibrator to loosen the debris from the wall of the well. A drawback of this method is that it is only effective for cleaning cuttings in very close proximity to the tool. Donwhole cleaning tools with fixed external blades have also been developed as a mechanical approach to hole cleaning. Such tools are use by reciprocating (alternatively raising or lowering) the drill string to assist in the removal of cuttings beds. These cleaning tools are not practical in non-accumulating cuttings areas (outside of the cutting bed) because the fixed blades increase the torque and drag on the drill string resulting reduction in circulation of the drilling fluid and overall cleaning effectiveness. In addition, moving the drill string up and down risks damaging the tool.

A recent development in the area of hole cleaning is the use of the principle of cavitation for removing cuttings, dirt, paraffins, asphaltenes, and other debris. Cavitation generally refers to the formation and instantaneous collapse of innumerable tiny vapor bubbles within a fluid subjected to rapid and intense pressure changes. A liquid subjected to a low pressure (tensile stress) above a threshold ruptures and forms vaporous cavities. When the local ambient pressure at a point in the liquid falls below the liquid's vapor pressure at the local ambient temperature, the liquid can undergo a phase change, creating largely empty voids termed cavitation bubbles. Fluid pumped through the tool drives a mechanical process that induces cavitation, and a flare of bubbles is released. The combined effects of the flow impact, the suction effects of the decaying bubble flare, and the implosion shock waves of the cavitation are effective to mobilize and remove debris that may be trapped in the wellbore.

SUMMARY OF THE INVENTION

The present inventions include a method for drilling a well with a drilling apparatus comprising a drill string and a bit, comprising attaching a cleaning tool comprising a coaxial pipe and at least one vortex spinner to a portion of the drill string above the bit, inserting the drill string into a wellbore, extending the wellbore while simultaneously pumping fluid through the cleaning tool to create a fluid flow, and loosening debris attached to the wellbore.

The present inventions include a cleaning tool comprising A cleaning tool comprising a coaxial pipe with a first end and a second end, at least one vortex spinner circumferentially connected to the coaxial pipe between the first end and the second end, and a fluid divider arranged inside the coaxial pipe.

The present inventions include a cleaning tool comprising a cleaning tool comprising a coaxial pipe with a first end and a second end, a plurality of nozzles located between the first end and the second end, and a fluid divider arranged inside the coaxial pipe; wherein the first end is connected to a first tubular and the second end is connected to a second tubular.

BRIEF DESCRIPTION OF THE DRAWINGS

The present invention is better understood by reading the following description of non-limitative embodiments with reference to the attached drawings, wherein like parts of each of the figures are identified by the same reference characters, and which are briefly described as follows.

DETAILED DESCRIPTION

For the purpose of this application, the terms used shall be understood as follows. The term "horizontal" or "deviated" well is used to describe an oil or gas well drilled at an angle at least 30 degrees from vertical. An "extended reach well" is generally defined as a well with a throw ratio of approximately 2:1 where the throw ratio is the ratio of horizontal depth to true vertical depth (TVD). The term "drill string" is used to refer to a conduit used to drill an oil and gas well including, but not limited to drill pipe and coiled tubing. The term "debris" is used to mean cuttings, pieces of rock chips, gravel, fines, asphaltenes, solids deposited to reduce fluid loss, and other particles that may interfere with the production or operation of a well.

Figure 1:
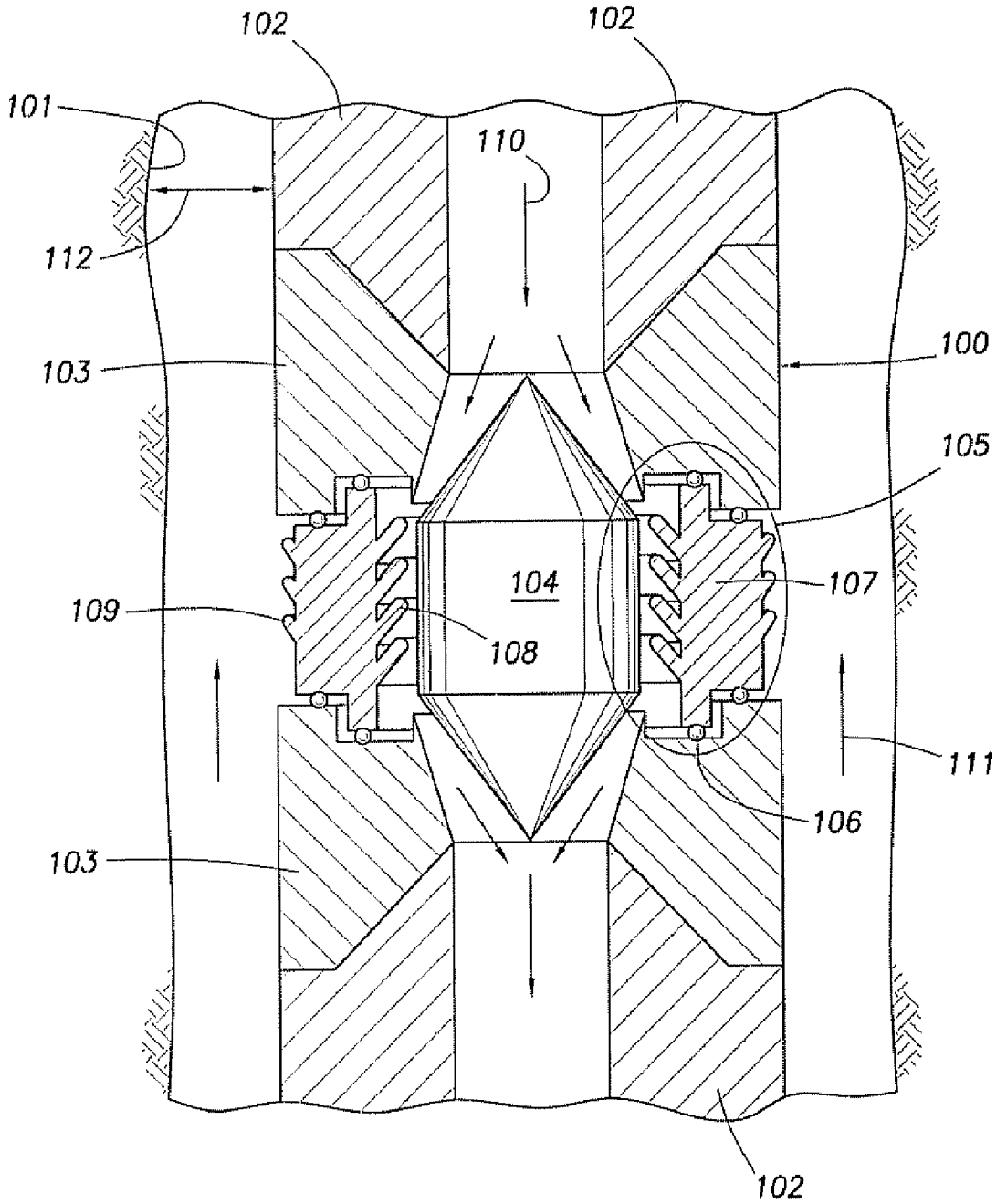
FIG. 1 illustrates a side view of one embodiment of a cleaning tool used during a drilling operation.

Referring to FIG. 1, one embodiment of downhole cleaning tool 100 is shown in use during a drilling operation of wellbore 101. Cleaning tool 100 is attached to a portion of drill string 102 and lowered into the well. Drill string 102 may be coiled tubing, drill pipe, or any other conduit in conventional drilling operations. The downhole cleaning tool is integrated with the drill string with the drill bit located further down the hole at the end of the drill string. In the embodiment shown, only one cleaning tool is depicted; however, multiple tools may be installed at various intervals along the drilling apparatus to increase the cleaning efficiency during drilling.

Figure 2:
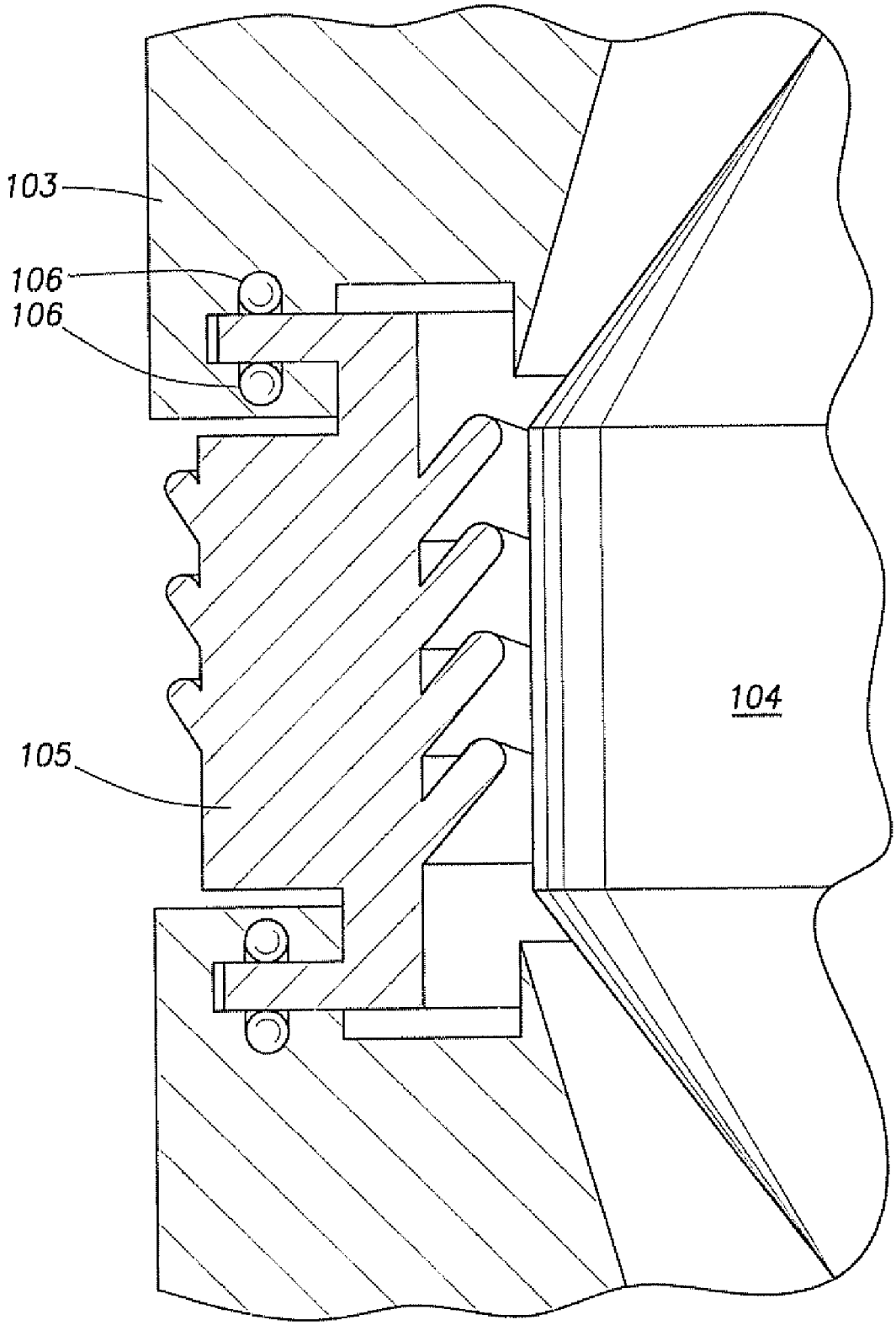
FIG. 2 illustrates a close-up side view of the one embodiment of the downhole cleaning tool.

Cleaning tool 100 may be made up of coaxial pipe 103, fluid divider 104, and vortex spinner 105 connectable around the circumference of the coaxial pipe. Connectors 106 hold the spinner in place, decrease friction of vortex spinner 105 while rotating, and seal the fluid flow from interior pipe to outside. FIG. 2 shows a close-up view of a portion of the downhole cleaning tool from FIG. 1 in which connectors 106 are roller bearings, or any similar connection apparatus. Vortex spinner 105 comprises spinner housing 107, interior spinner blades 108, and exterior spinner blades 109.

During operation, fluid is pumped down drill string 102 through cleaning tool 100 towards the drill bit as represented by arrow 110. Drilling fluid may be used in this application and the presence of the tool does not substantially alter the normal circulation process. When the fluid moves through fluid divider 104, the pressure decrease causes the velocity of the fluid to increase. Alternatively fluid divider 104 may be removed from the design. The fluid hits interior spinner blades 108 and causes coaxial pipe 103 to rotate at a specified speed. The effect of vortex spinner 105 and exterior spinner blades 109 agitates the fluid in annulus 112 and releases debris attached to the wall of the wellbore. The fluid then passes through the drilling assembly. Mobilized debris is circulated along annulus 112 (according to arrow 111) to the surface.

Figure 3:
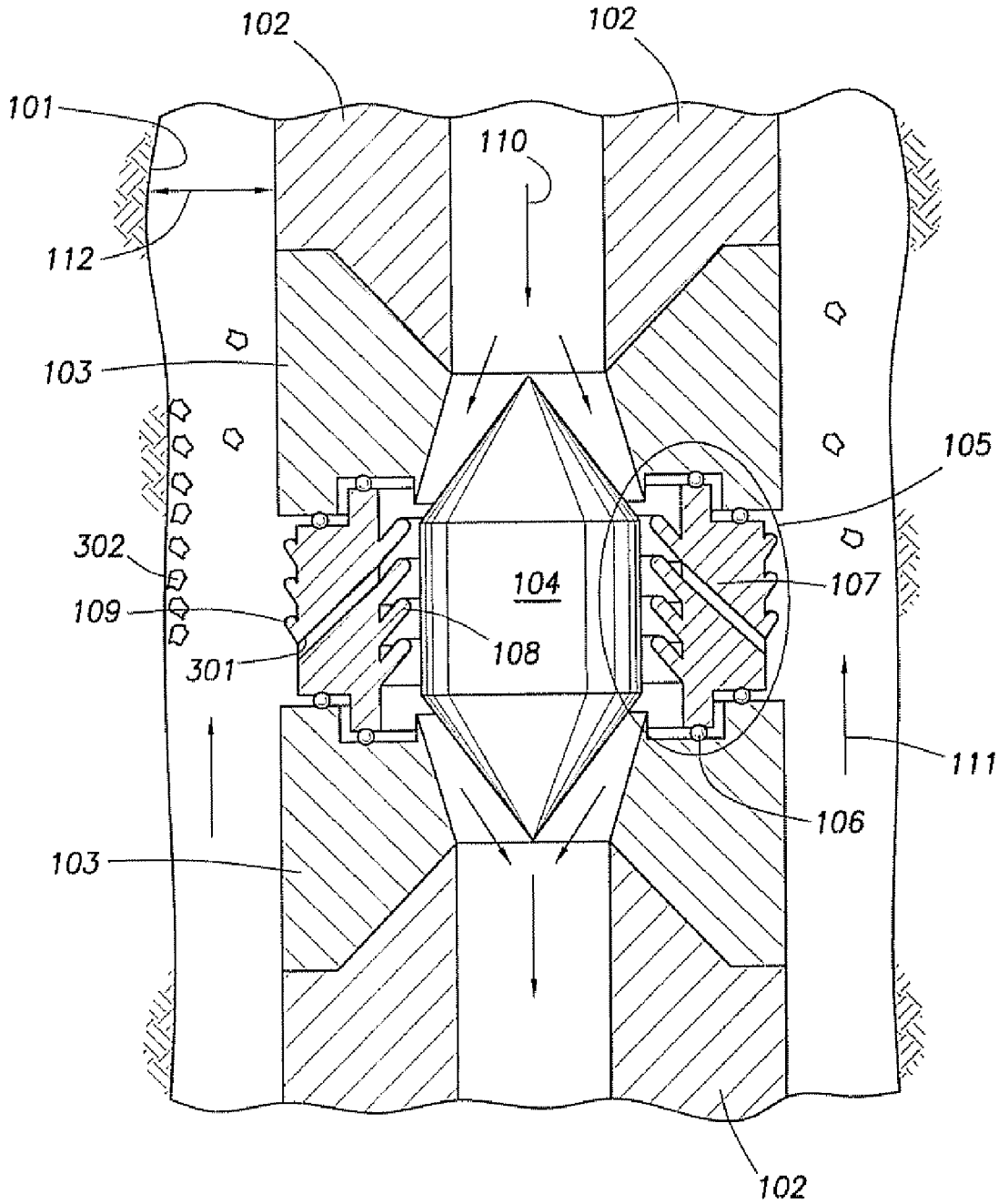
FIG. 3 illustrates a side view of another embodiment of the cleaning tool used during a drilling operation.

FIG. 3 shows an alternative embodiment of the downhole cleaning tool. In this embodiment, nozzles 301 may be attached to vortex spinner 105 to enhance the cleaning process. The number of nozzles and angles at which the nozzles are positioned may be adjusted based on well conditions. Optionally the nozzles may be equipped with nozzles heads (not shown) to direct fluid as it exists the nozzle. Optionally the nozzles may be threaded or otherwise manufactured to direct fluid flow. When fluid is pumped down along arrow 110, a portion may pass through nozzle 301 to agitate debris 302 and loosen it from the wellbore. The rest of the fluid continues through the tool to activate rotate the components to induce cavitation.

Figure 4:
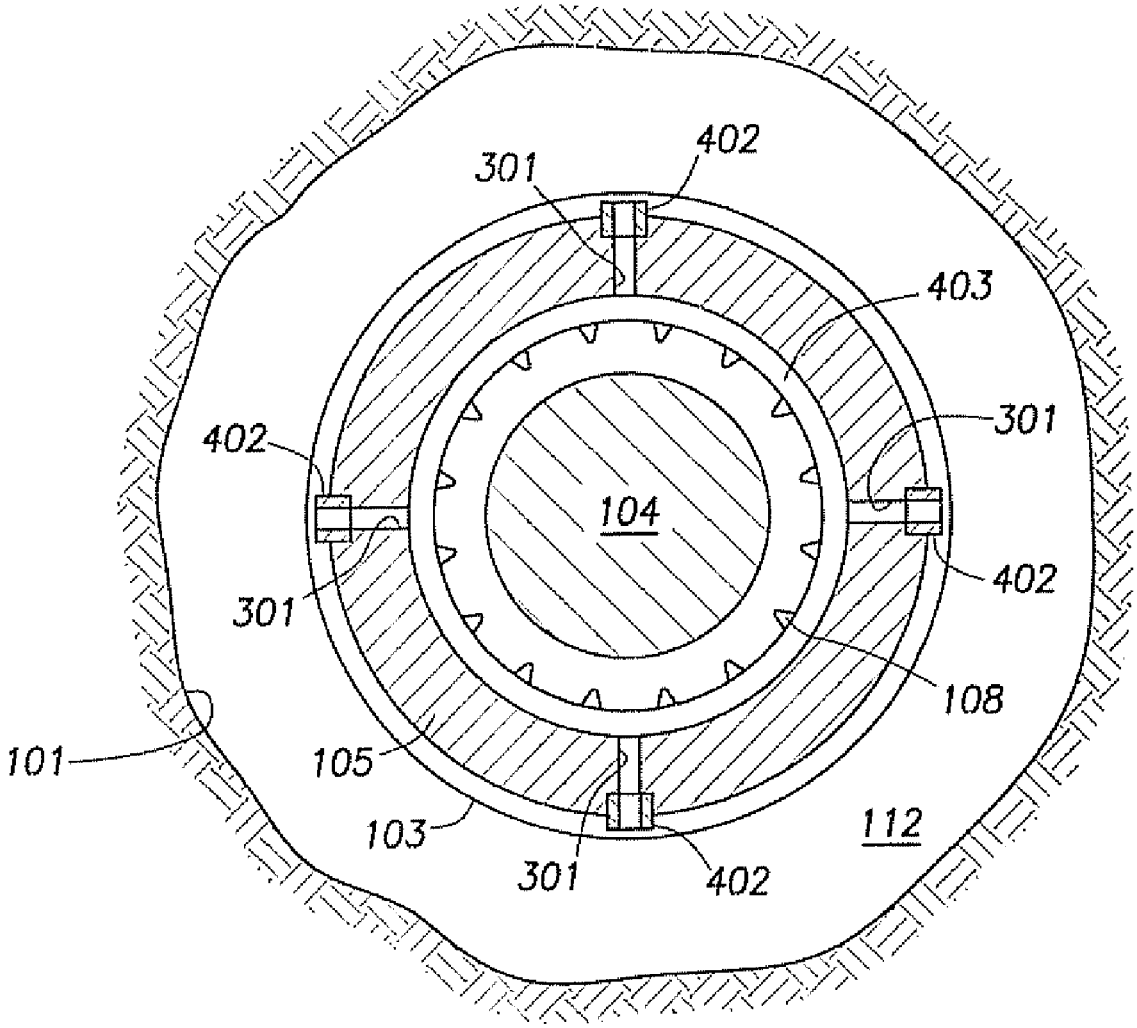
FIG. 4 illustrates a top view of the cleaning tool.

FIG. 4 shows a top view of the embodiment of the downhole cleaning tool from FIG. 3 in wellbore 101. Coaxial pipe 103 is shown encircled by vortex spinner 105. A plurality of nozzles 301 extend through vortex spinner 105. In this embodiment, four nozzles are shown; however more could be included in a variety of arrangements. Each nozzle may be equipped with a nozzle head 402 at its end, which can be adjusted to set the angle at which fluid exists the tool. Each nozzle may be connected to a hole in the inner wall of vortex spinner 105. Fluid breaker 403 encircles the inner wall of vortex spinner 105 beneath the holes leading to the nozzles.

During operation, fluid flows across fluid divider 104 and experiences an increase in velocity. Alternatively, the fluid divider could be omitted and the vortex spinner driven with the natural velocity of the fluid. A portion of the fluid hits interior spinner blades 108 and causes coaxial pipe 103 (or is it vortex spinner 105?) to rotate at a specified speed. A different portion of the fluid may enter nozzles 301 and is shot against the formation to loosen debris. The rest of the fluid may continue through the tool to activate the cavitation process via vortex spinners 105. One possible path of the fluid is shown by arrows 404; however, others paths are possible.

Figure 5:
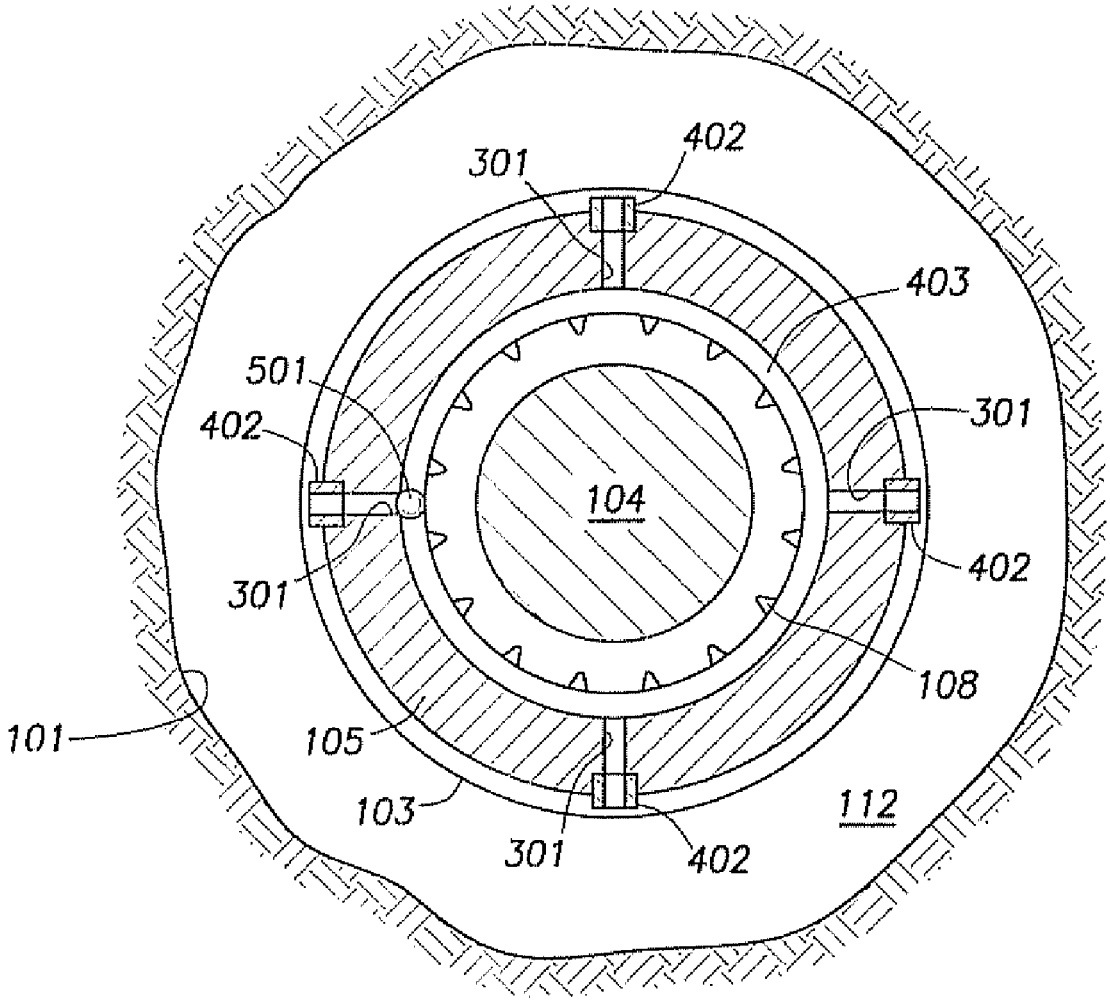
FIG. 5 illustrates a top view of the cleaning tool with a ball dropped to deactivate one of the nozzles.
Figure 6:
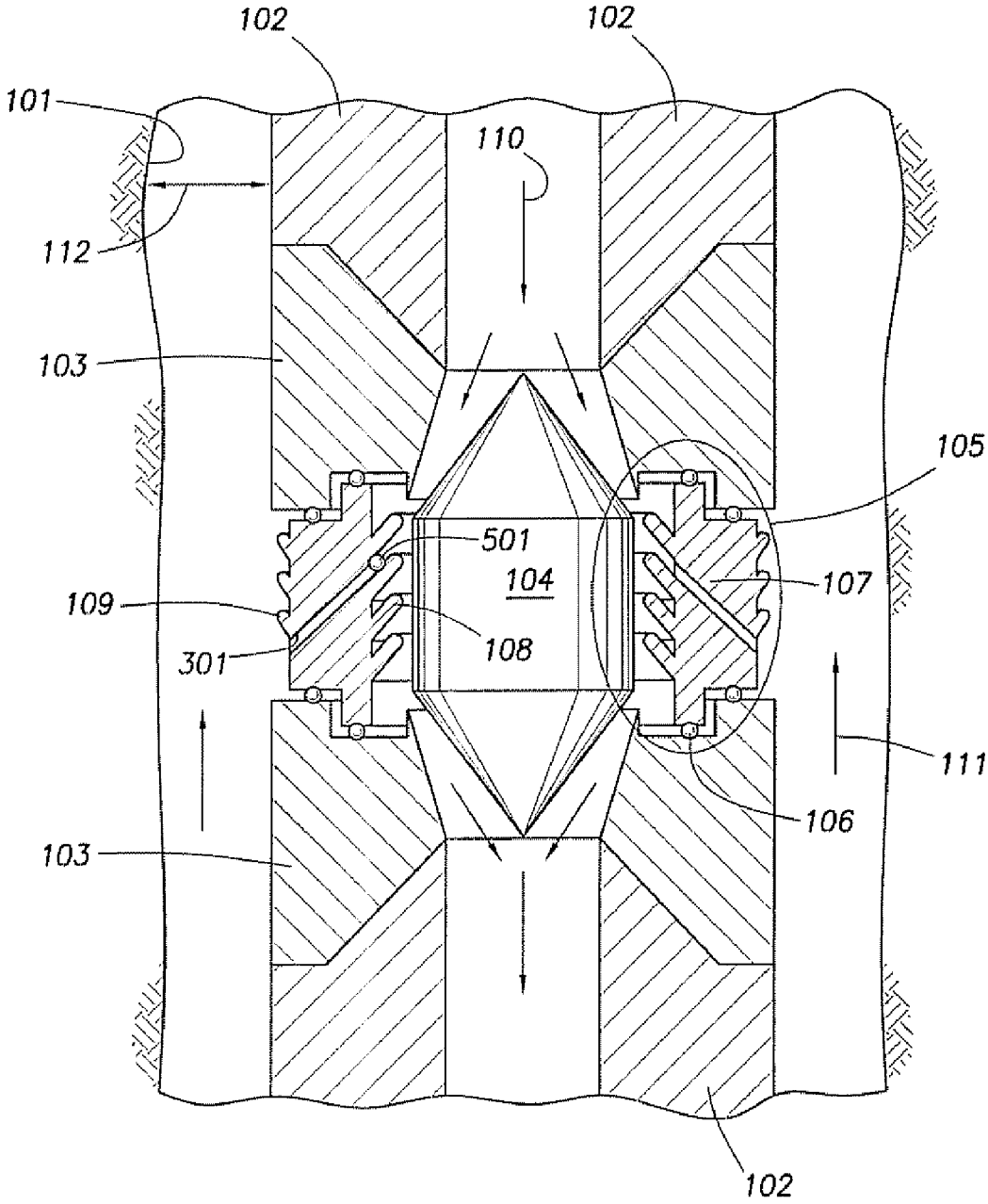
FIG. 6 illustrates a side view of the cleaning tool with a ball dropped to deactivate one of the nozzles.
Figure 7:
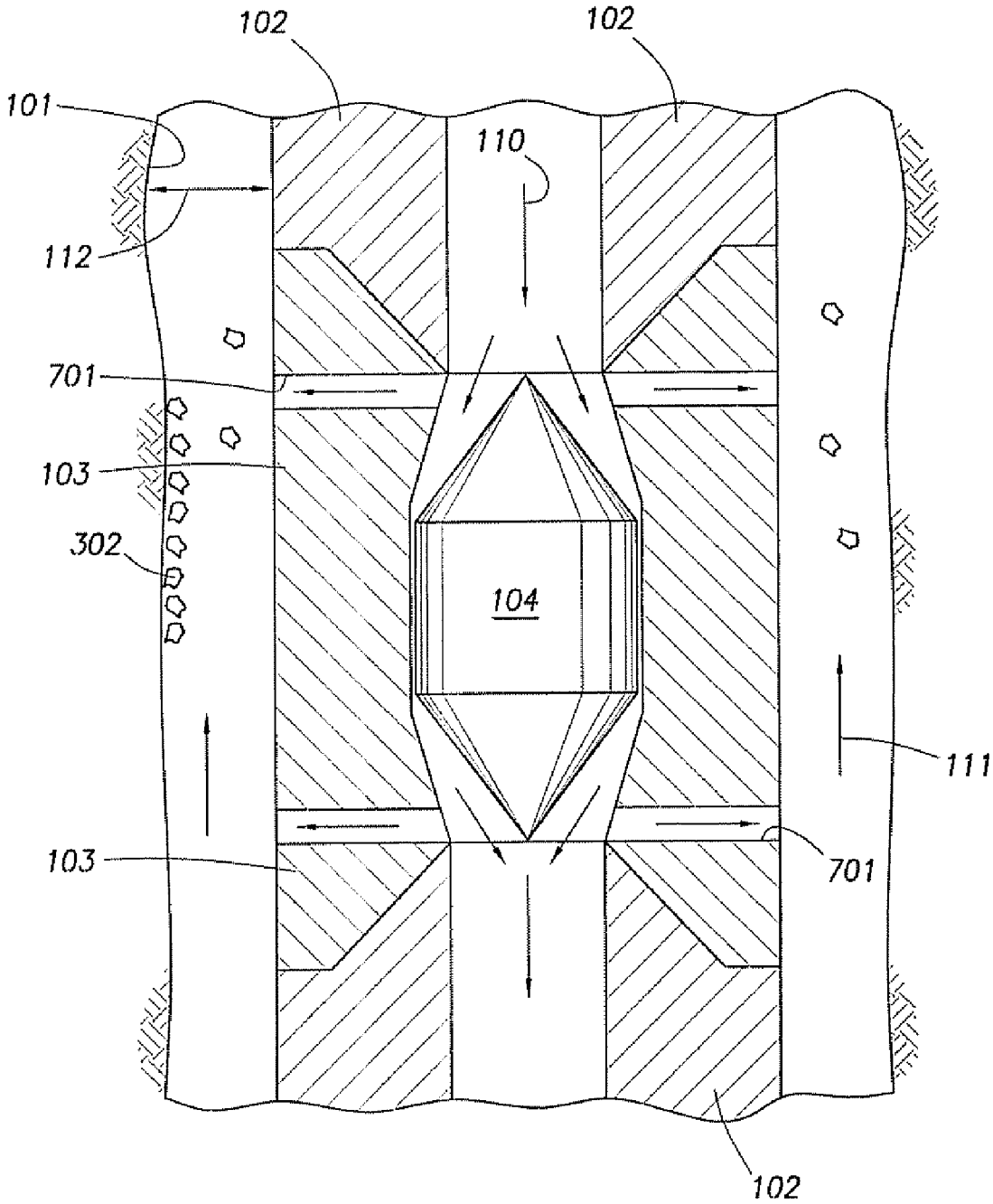
FIG. 7 illustrates a side view of another embodiment of the cleaning tool used during a drilling operation.

When the operator no longer requires the use of one of the nozzles, controllable passageways capable of stopping fluid communication in one or all of the nozzles may be used. In one embodiment, a ball 501 may be dropped to deactivate the nozzle. FIG. 5 shows a top view of the tool with ball 501 resting on fluid breaker 403 and blocking the hole, which leads the leftmost nozzle. FIG. 6 shows a side view of the same scenario. Alternatively another mechanism known in the industry to block flow such as a flapper valve. Alternatively, as shown in FIG. 7, the vortex spinners may be removed and replaced with pipe 103 so that the tool is simplified to only include the nozzle cleaning mechanism. Any other method that achieves the effect of the controllable passageways may be used.

Advantages of some embodiments of the invention may include one or more of the following:

- Allows the assembly of one or multiple fluid-driven rotary cleaning subs as needed anywhere in the drilling assembly eliminating the limitations of tools that may only be installed at the end of the drill string
- Enables drillers to use the hole cleaning system as a continuous phase while drilling eliminating the additional trips required to disassemble the bit and install the cleaning system
- Reduces or eliminates backreaming
- Provides reduced open hole time during drilling and effective hole cleaning enhancing borehole stability, reducing drilling cost, and minimizing the risk of the pipe sticking
- In shaly formations, decreases coagulation of the drilling fluid
- Prevents settling of drill cuttings
- Increases lifetime of drill bit and other drilling tools
- Prevents drilling-induced fracture creation and lost circulation
- Prevents hole enlargement
- Reduces need for large mud pump capacity
- Allows variable depth penetration and cleaning distance Those of skill in the art will appreciate that many modifications and variations are possible in terms of the disclosed embodiments, configurations, materials, and methods without departing from their spirit and scope. Accordingly, the scope of the claims appended hereafter and their functional equivalents should not be limited by particular embodiments described and illustrated herein, as these are merely exemplary in nature.

That which is claimed is:

1. A cleaning tool for a wellbore comprising:

a coaxial pipe with a first end and a second end;

at least one vortex spinner circumferentially connected to the coaxial pipe between the first end and the second end and comprising a spinner housing, a set of interior spinner blades, and a set of exterior spinner blades; and a fluid divider arranged inside the coaxial pipe;

wherein rotating the coaxial pipe causes cavitation of the fluid thereby loosening debris in the wellbore.

2. The cleaning tool of claim 1 wherein the coaxial pipe is rotated when fluid is pumped across the fluid divider and hits the interior spinner blades.

3. The cleaning tool of claim 2 wherein the first end of the coaxial pipe is connected to a first tubular and the second end of the coaxial pipe is connected to a second tubular.

4. The cleaning tool of claim 3 wherein the first tubular is selected from the group consisting of casing, coiled tubing, and drill pipe.

5. The cleaning tool of claim 3 wherein the second tubular is connected to a drill bit.

6. The cleaning tool of claim 1 further comprising a plurality of nozzles located on the coaxial pipe or the at least one vortex spinner, wherein the plurality of nozzles create fluid communication between the interior of the coaxial pipe and an annulus defined by the area between the coaxial pipe and the wellbore.

7. The cleaning tool of claim 6 wherein the at least one vortex spinner is connected to the coaxial pipe with rollers or bearings whereby the spinner housing is rotatable around an axis substantially parallel to the wellbore.

* * * * *